US009261860B2

(12) United States Patent
Hasegawa

(10) Patent No.: US 9,261,860 B2
(45) Date of Patent: Feb. 16, 2016

(54) ANALOG ELECTRONIC TIMEPIECE

(71) Applicant: CASIO COMPUTER CO., LTD., Shibuya-ku, Tokyo (JP)

(72) Inventor: Kosuke Hasegawa, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/195,570

(22) Filed: Mar. 3, 2014

(65) Prior Publication Data

US 2014/0286138 A1 Sep. 25, 2014

(30) Foreign Application Priority Data

Mar. 21, 2013 (JP) ..... 2013-058018

(51) Int. Cl.
*G04C 3/14* (2006.01)
*G04C 17/00* (2006.01)

(52) U.S. Cl.
CPC *G04C 3/14* (2013.01); *G04C 3/146* (2013.01); *G04C 17/0066* (2013.01)

(58) Field of Classification Search
CPC ..... G04C 3/14; G04C 17/0066; G04C 3/146
USPC ..... 368/80, 81
See application file for complete search history.

(56) References Cited

U.S. PATENT DOCUMENTS

| | | | | |
|---|---|---|---|---|
| 4,623,261 | A * | 11/1986 | Muto | 368/80 |
| 5,195,062 | A * | 3/1993 | Masahiro et al. | 368/21 |
| 5,237,544 | A * | 8/1993 | Sase et al. | 368/21 |
| 6,185,158 | B1 | 2/2001 | Ito et al. | |
| 6,639,874 | B2 * | 10/2003 | Shimizu et al. | 368/73 |

FOREIGN PATENT DOCUMENTS

| | | | |
|---|---|---|---|
| JP | 10073673 | A | 3/1998 |
| JP | 2010-223689 | A | 10/2010 |

OTHER PUBLICATIONS

Japanese Office Action dated Dec. 16, 2014, issued in counterpart Japanese Application No. 2013-058018.

* cited by examiner

*Primary Examiner* — Sean Kayes
(74) *Attorney, Agent, or Firm* — Holtz, Holtz & Volek PC

(57) ABSTRACT

An analog electronic timepiece, including: a stepping motor; a first indicating unit which makes a step rotation by a predetermined first rotation angle according to the step drive; a second indicating unit which makes a step rotation by a second rotation angle which is smaller than the first rotation angle in conjunction with the step rotation of the first indicating unit; an independent rotation control unit; an interlocking rotation control unit; and a rotation selection unit which activates the independent rotation control unit when current processing is in an operation mode where the rotation position of the first indicating unit is changed or in an operation state where the rotation position of the first indicating unit is temporarily changed and which activates the interlocking rotation control unit when a setting relating to a final rotation position of the first indicating unit is fixed.

20 Claims, 6 Drawing Sheets

ANALOG ELECTRONIC TIMEPIECE

BACKGROUND OF THE INVENTION

1. Field of the Invention

The present invention relates to an analog electronic timepiece.

2. Description of Related Art

Conventionally, there have been analog electronic timepieces which can perform display relating to various functions in addition to the time display function. Some of the analog electronic timepieces include function hands and rotating plates used for display relating to other functions and used for indicating the function types of the displayed contents in addition to time hands such as hour hands and minute hands which are used when displaying time and a date wheel displaying an indicator indicating a date.

In such multifunctional electronic timepiece, each of the hands and the rotating plates is required to have its own operation which is different from the time display and is able to be rotated independently by an individual stepping motor and a gear train mechanism in some cases. However, when the number of the hands and the rotating plates increases, more electric power is required to drive the stepping motors and more space is required to provide the stepping motors and the gear train mechanisms, leading to enlargement of timepieces. Thus, in some of such electronic timepieces, a function hand and a rotating plate which do not need to operate independently are combined so as to be rotated in conjunction with each other by a single stepping motor and the configuration and location of the gear train mechanisms are contrived to save the space, which is described in Japanese Patent Laid-Open Publication No. 2010-223689, for example.

However, since there is a limit to the number of stepping motors which can be located inside a timepiece having a predetermined size, stepping motors cannot be effectively utilized if they are provided for independently driving the hand and the rotating plate which operate less frequently. On the other hand, if a plurality of hands and rotating plates which perform display independently are operated by a single stepping motor, the number of operations of the stepping motor increases to maintain a plurality of display contents accurately and more operation time is required for maintaining the accurate display condition, leading to inferior usability for a user.

The present invention relates to an analog electronic timepiece which can operate a plurality of hands effectively without deteriorating usability for a user.

SUMMARY OF THE INVENTION

According to one aspect of the present invention, there is provided an analog electronic timepiece, including: a stepping motor which is driven by a step drive; a first indicating unit which makes a step rotation by a predetermined first rotation angle according to the step drive; a second indicating unit which makes a step rotation by a second rotation angle which is smaller than the first rotation angle in conjunction with the step rotation of the first indicating unit; an independent rotation control unit which drives the stepping motor by the step drive in accordance with a setting relating to a rotation position of the first indicating unit; an interlocking rotation control unit which drives the stepping motor by the step drive so that the rotation position of the first indicating unit and a rotation position of the second indicating unit be at positions which are set; and a rotation selection unit which activates the independent rotation control unit when current processing is in an operation mode where the rotation position of the first indicating unit is changed or in an operation state where the rotation position of the first indicating unit is temporarily changed and which activates the interlocking rotation control unit when a setting relating to a final rotation position of the first indicating unit is fixed.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein.

DETAILED DESCRIPTION OF THE PREFERRED EMBODIMENT

Hereinafter, embodiments of the present invention will be described on the basis of the drawings.

Figure 1:
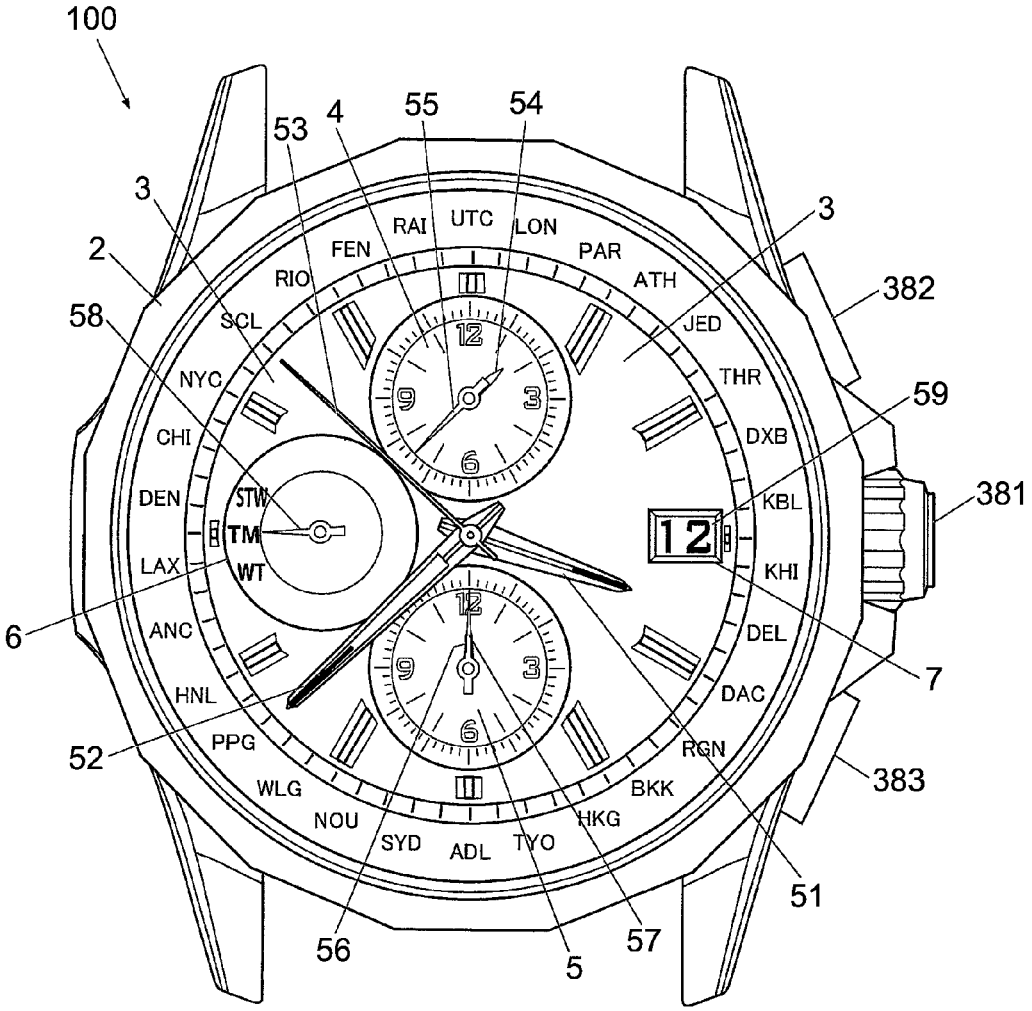
FIG. 1 is a plan view showing an analog electronic timepiece in an embodiment of the present invention.

FIG. 1 is a plan view of an analog electronic timepiece 100 in the embodiment of the present invention.

The analog electronic timepiece 100 of the embodiment is a wristwatch type which can be worn around the wrist (arm) by using a band not shown in the drawings, and a plurality of hands are located so as to be rotatable between a display panel 3 provided inside a casing 2 and a watch glass (not shown in the drawings) covering the upper surface of the display panel 3. In addition, a crown 381 and two push buttons 382 and 383 are provided on a side surface of the casing 2.

Among the plurality of hands, an hour hand 51, a minute hand 52 and a second hand 53 are rotated around a same rotation shaft provided at a nearly central position of the display panel 3. Hereinafter, display by the hour hand 51, the minute hand 52 and the second hand 53 is indicated as center display, and an area of the display panel 3 where scales relating to the center display are provided and an area pointed by the hour hand 51, the minute hand 52 and the second hand 53 are indicated as a center display area. Round display areas 4, 5 and 6 are respectively provided in the 12 o'clock, 6 o'clock and 9 o'clock sides on the display panel 3. A first small short hand 54 and a first small long hand 55 are located so as to be rotatable inside the display area 4, a second small short hand 56 and a second small long hand 57 are located so as to be rotatable inside the display area 5, and a function hand 58 (first indicating unit, mode hand) is located so as to be rotatable inside the display area 6.

Hereinafter, a part or all of hands, which are two or more hands, among the hour hand 51, the minute hand 52, the second hand 53, the first small short hand 54, the first small long hand 55, the second small short hand 56, the second small long hand 57 and the function hand 58 are also collectively indicated as the hands 51 to 58, for example. Furthermore, the hands 51 to 57 are functional hands.

A date wheel 59 (second indicating unit) which is a rotating plate is provided under the display panel 3. The date wheel 59 has date indicators (indicators) indicating dates from the 1st to 31st which are formed in order on a circular edge portion rotating with respect to the rotation shaft of the date wheel 59, and one of the date indicators is exposed through a small window 7 which is provided in the 3 o'clock side of the display panel 3 to display the date. In the analog electronic timepiece 100 of the embodiment, the small window 7 has a size such that one of the date indicators can be exposed.

On the display panel 3, time characters which indicate positions (directions) of 1 o'clock to 12 o'clock are provided on a circular edge portion with respect to a rotation shaft of the hour hand 51, the minute hand 52 and the second hand 53, second scales indicating 0 to 59 seconds are provided on another circular edge portion, and city names which can be selected when performing display relating to the world clock are provided in abbreviated names on an edge portion of the display panel 3 which is further outside the circular edge portions on which the time characters and the second scales are provided.

Same scales are provided in the display areas 4 and 5. As the scales, the time characters are provided on an inner circular edge portion and the second scales indicating seconds are provided on an outer circular edge portion in each of the areas 4 and 5 of the analog electronic timepiece 100 in the embodiment. Accordingly, time display and second value display in a stopwatch function can be performed in any of the center display area and the display areas 4 and 5.

On the other hand, type indicators "STW", "TM" and "WT" indicating the function types are provided at the left side in the display area 6.

Figure 2:
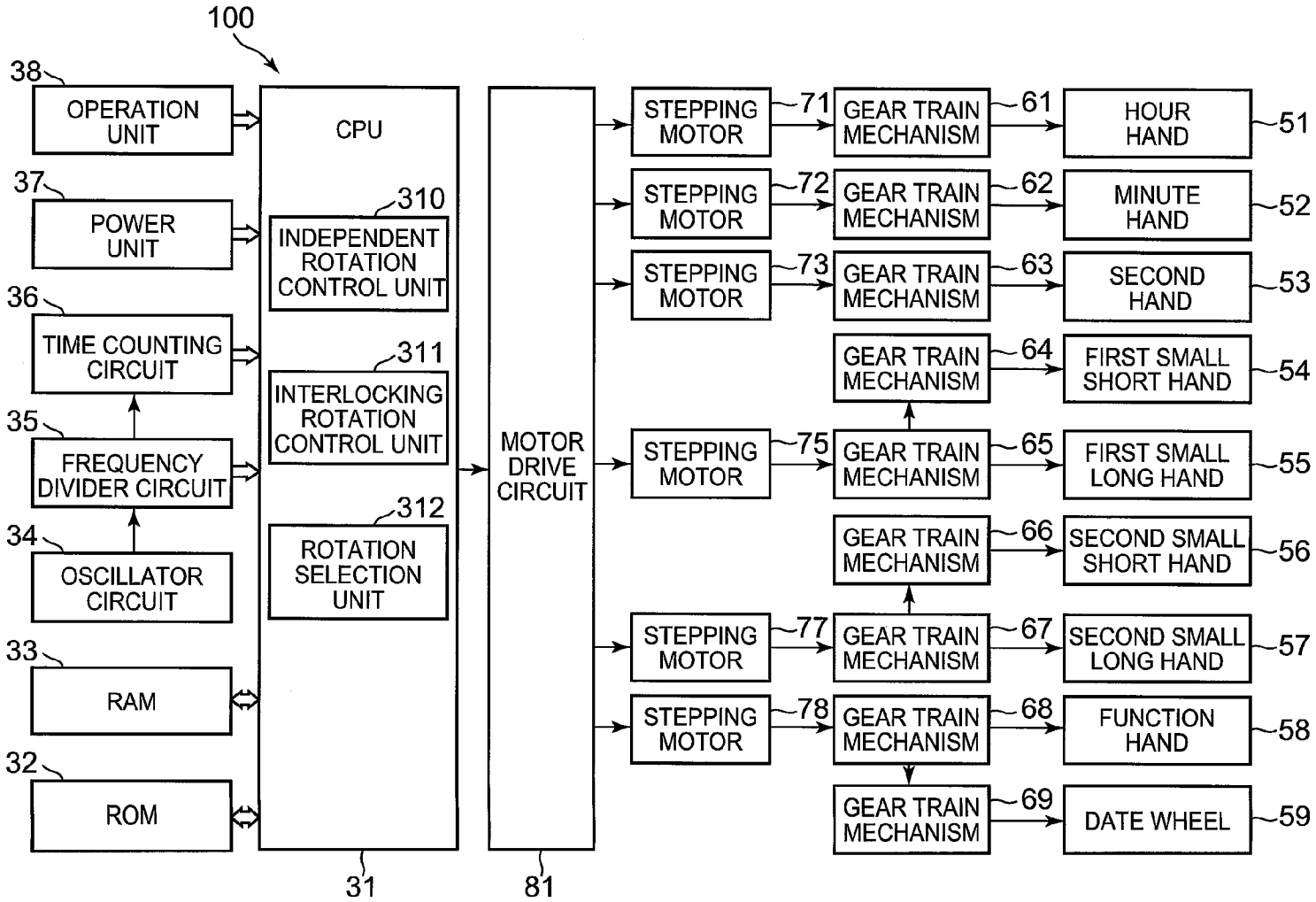
FIG. 2 is a block diagram showing an internal configuration of the analog electronic timepiece.

FIG. 2 is a block diagram showing an internal configuration of the analog electronic timepiece 100 of the embodiment.

The analog electronic timepiece 100 includes a CPU (Central Processing Unit) 31 (independent rotation control unit 310, interlocking rotation control unit 311 and rotation selection unit 312), a ROM (Read Only Memory) 32 (storage unit), a RAM (Random Access Memory) 33, an oscillator circuit 34, a frequency divider circuit 35, a time counting circuit 36, a power unit 37, an operation unit 38 (operation unit), a motor drive circuit 81, gear trains mechanisms 61 to 69 (gear trains), stepping motors 71 to 73, 75, 77 and 78, the hour hand 51, the minute hand 52, the second hand 53, the first small short hand 54, the first small long hand 55, the second small short hand 56, the second small long hand 57, the function hand 58, the date wheel 59 and such like.

The stepping motors 71 to 73 individually rotates the hour hand 51, the minute hand 52 and the second hand 53 via the gear train mechanisms 61 to 63, respectively. The stepping motor 75 rotates the first small long hand 55 via the gear train mechanism 65 and rotates the first small short hand 54 via the gear train mechanism 64 which operates in conjunction with the gear train mechanism 65. The stepping motor 77 rotates the second small long hand 57 via the gear train mechanism 67 and rotates the second small short hand 56 via the gear train mechanism 66 which operates in conjunction with the gear train mechanism 67. The stepping motor 78 rotates the function hand 58 via the gear train mechanism 68 and rotates the date wheel 59 via the gear train mechanism 69 which operates in conjunction with the gear train mechanism 68.

Each of the stepping motors 71 to 73, 75, 77 and 78 is driven (step drive) by a drive voltage pulse output from the motor drive circuit 81, and makes a step rotation by a predetermined angle (for example, 180 degrees). Each of the gear train mechanisms 61 to 69 has a configuration in which a plurality of gears are engaged with each other and rotated by a predetermined gear ratio, and the last gears of the gear train mechanisms 61 to 63, 65, 67 and 68 operate in conjunction with the step rotations of the stepping motors 71 to 73, 75, 77 and 78, respectively, and transmits the rotation operations of respective predetermined angles to the hour hand 51, the minute hand 52, the second hand 53, the first small long hand 55, the second small long hand 57 and the function hand 58 to point at respective desired positions (rotation positions). Here, the hour hand 51, the minute hand 52, the first small long hand 55, the second small long hand 57 and the function hand 58 make a rotational movement (step rotation) by one degree (first rotation angle) per step and the second hand 53 makes a rotational movement by six degrees per step. Each of the hands 51 to 58 and the date wheel 59 can be fast forwarded at 64 pps (pulse per second) in the forward direction and fast forwarded at 32 pps in the backward direction.

The gear train mechanisms 64, 66 and 69 have gears which are rotated in conjunction with the rotations of gears of the gear train mechanisms 65, 67 and 68, respectively, and transmit the respective rotation operations of the predetermined angles to the first small short hand 54, the second small short hand 56 and the date wheel 59. The first small short hand 54 and the second small short hand 56 are rotated by rotation angles which are 1/12 of the rotation angles of the first small long hand 55 and the second small long hand 57, respectively. That is, while the first small long hand 55 and the second small long hand 57 make one rotation (360 degrees rotation) around the rotation shafts inside the display areas 4 and 5, respectively, the first small short hand 54 and the second small short hand 56 are rotated by 30 degrees in the same rotation direction as the first small long hand 55 and the second small long hand 57, respectively. The gear train mechanism 69 is configured to have a gear ratio of 1:372 so that the date wheel 59 is rotated by an angle (a predetermined angle interval, for example, approximately 11.61 degrees) corresponding to the change of the date indicator, for an amount of a single day, exposed through the small window 7 when the function hand 58 makes twelve rotations around the rotation shaft inside the display area 6, and the date wheel 59 makes a rotational movement by 1/372 degrees (second rotation angle) per step.

Plays (backlashes) exist between a plurality of gears which form each of the gear train mechanisms 61 to 69. Accordingly, in a case where the rotation direction of the hands 51 to 58 and the date wheel 59 is switched between the forward direction and the backward direction, intermediate gears in each of the gear train mechanisms 61 to 69 rotate idly and the hands 51 to 58 and the date wheel 59 are not rotated while the stepping motors 71 to 73, 75, 77 and 78 make step rotations a predetermined number of times (number of idle rotation steps).

In the analog electronic timepiece 100 of the embodiment, in a case where a hand is to be moved in the backward direction, the stepping motor needs to perform a reverse operation that is rotating backward for the extra number of steps (number of reverse steps) which is the number of idle rotation steps of the hand or the larger number and thereafter rotating forward for the number of reverse steps in order to resolve the idle rotation according to the rotation in the forward direction. The function hand 58 and the date wheel 59 have a different number of idle rotation steps, and the date wheel 59 has a larger number of idle rotation steps. Accordingly, when the function hand 58 is moved backward, the date wheel 59 is located at a position shifted (positioned in the forward direction) from the position thereof when the function hand 58 is rotated in the forward direction by at most the difference in number of idle rotation steps between the function hand 58 and the date wheel 59. The numbers of reverse steps are previously stored in the ROM 32 and read out at the reverse operation.

The CPU 31 performs various arithmetic processing and integrally controls the entire operation of the analog electronic timepiece 100. In the ROM 32, control programs or setting data according to operations of the analog electronic timepiece 100 are stored. The RAM 33 is a volatile memory which provides a working memory to the CPU 31 and stores temporary data and setting data which is updatable. The updatable setting data includes display setting relating to the type classification of functions displayed in each of the three display areas. In the RAM 33, current hand position data of the hands 51 to 58 and the date wheel 59 and setting position data of the hands 51 to 58 or the data indicator 59 are stored. In addition to or partially replacing the RAM 33, a non-volatile memory such as a flash memory may be included to store the setting data updatable by a user so as to be readable and writable. Also, the above number of reverse steps may be written to the non-volatile memory at the time of inspection in factories.

The motor drive circuit 81 outputs a voltage drive pulse for driving each of the stepping motors 71 to 73, 75, 77 and 78 at an appropriate timing and with an appropriate pulse width according to a control signal input from the CPU 31.

The oscillator circuit 34 is a circuit which generates a predetermined frequency signal, and a crystal oscillator is used here, for example. The frequency divider circuit 35 divides the signal input from the oscillator circuit 34 into signals of various frequencies used in the analog electronic timepiece 100 and outputs the signals to the CPU 31 and the time counting circuit 36. The time counting circuit 36 counts the signals input from the frequency divider circuit 35 and adds the counted number to the initial time to obtain the current time.

The power unit 37 supplies electric power to the units of the analog electronic timepiece 100. The power unit 37, for example, is obtained by combining a photovoltaic unit and a secondary battery. Electric power generated by using a solar panel (not shown in the drawings) provided on the display panel 3 is supplied to the units and charged in the secondary battery, and when electric power cannot be generated, the charged electric power is supplied from the secondary battery.

The operation unit 38 includes the crown 381 and the push button switches 382 and 383, and input operations to the crown 381 and the push button switches 382 and 383 by the user are converted into electric signals and output to the CPU 31. The push button switches 382 and 383 are used for operations such as start, end and reset of the time counting relating to the stopwatch function, for example. In the analog electronic timepiece 100 of the embodiment, the crown 381 can be drawn at two levels, and a city which is a target to be displayed relating to the world clock display is switched, for example, according to the level of the drawing, the direction and angle of the rotation operation and combinations of them with the pressing operation of the push button switches 382 and 383.

Next, hand operations and display operations based on the hand operations of the analog electronic timepiece 100 in the embodiment will be described.

In the analog electronic timepiece 100, when the position of each of the hands is to be changed, setting position data which indicates the destination of the hand is written to the RAM 33 first. The setting position data is periodically compared with the current position data of the hand, and when the current position is detected to be different from the setting position, a drive signal driving the stepping motor corresponding to the hand to be moved is output to the motor drive circuit 81. When each of the hands is to be fast forwarded, the fast forward direction and the number of fast forward steps are determined on the basis of the destination, and thereafter, interrupt processing according to the fast forwarding is invoked to fast forward the hand to be moved at a fast forward speed which is previously set, that is, at 64 pps in the forward direction and at 32 pps in the backward direction.

In the analog electronic timepiece 100 of the embodiment, the displays relating to the three types of functions that are a current time display function of displaying the current time in a set city (home city), a world clock display function of displaying the time in a city which is selected in the world and the stopwatch function are assigned to the three display areas which are the center display area and the display areas 4 and 5 and displayed in the respective areas. The analog electronic timepiece 100 is provided with an operation mode in which the assignment of the displays relating to the three types of functions to the three display areas is switched in accordance with the input operation to the operation unit 38 by the user in addition to operations relating to the change and correction of positions of the hands in the display areas.

Figure 3:
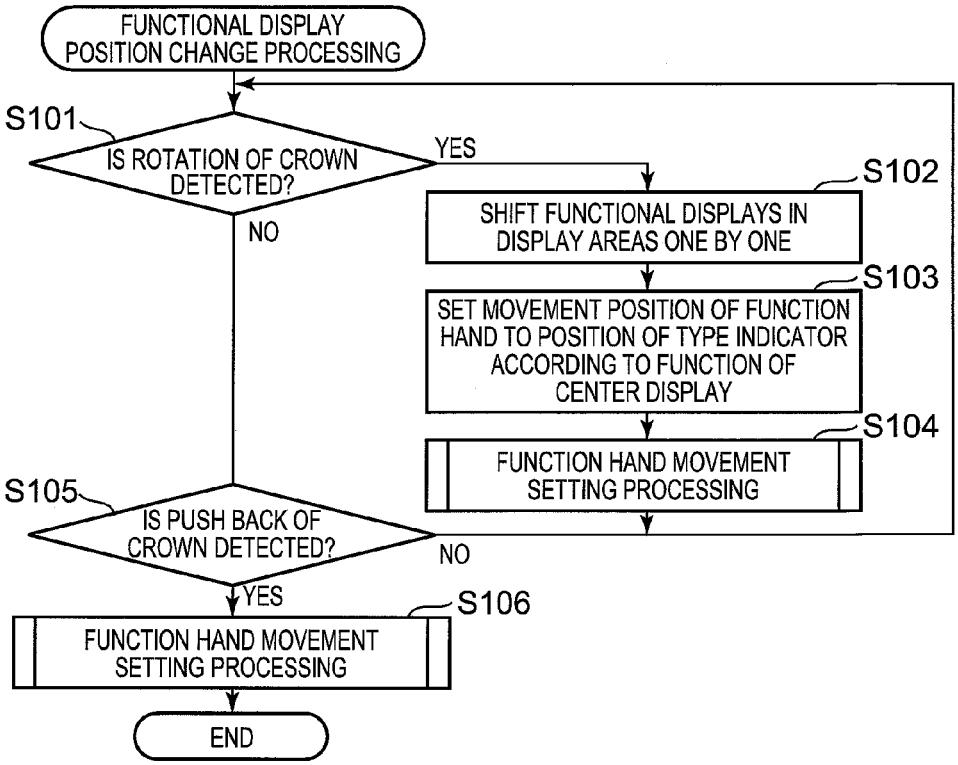
FIG. 3 is a flowchart showing a control procedure of functional display position change processing in the analog electronic timepiece of the embodiment.

FIG. 3 is a flowchart showing a control procedure by the CPU 31 of functional display position change processing executed in the analog electronic timepiece 100 of the embodiment.

In the analog electronic timepiece 100 of the embodiment, the functional display position change processing is started by drawing the crown 381 to the first level, for example. When the functional display position change processing is started, in a case where the date wheel 59 is being operated, the CPU 31 interrupts the operation first, and then determines whether the rotation operation of the crown 381 is detected (step S101). If it is determined that the rotation operation is detected (YES in step S101), the CPU 31 performs processing of shifting the function type of contents displayed in each of the display areas one by one (step S102). Specifically, in a case where the current time is displayed in the center display area, the world clock is displayed in the display area 4 and the display relating to the stopwatch function is performed in the display area 5 as shown in FIG. 1, the CPU 31 outputs, to the motor drive circuit 81, a control signal for moving the hands 51 to 58 so as to perform the world clock display in the center display area, the display relating to the stop watch function in the display area 4 and the current time display in the display area 5. In addition, the CPU 31 sets the position of the type indicator corresponding to the function type of the displayed content which is moved to the center display as the moving position of the function hand 58 (step S103). The CPU 31 invokes after-mentioned function hand movement setting processing (step S104). Then, the CPU 31 starts the fast forward movement of the function hand 58, and thereafter, returns the processing to step S101.

On the other hand, if it is determined that the rotation operation is not detected (NO in step S101), the CPU 31 determines whether the operation of pushing back the crown 381 which has been drawn is detected (step S105). If it is determined that the push back operation is not detected (NO in step S105), the CPU 31 returns the processing to step S101.

If it is determined that the push back operation is detected (YES in step S105), the CPU 31 fixes the functional display position which is set in the functional display position change processing, and then invokes and executes the function hand movement setting processing (step S106). Then, the CPU 31 ends the functional display position change processing.

Figure 4:
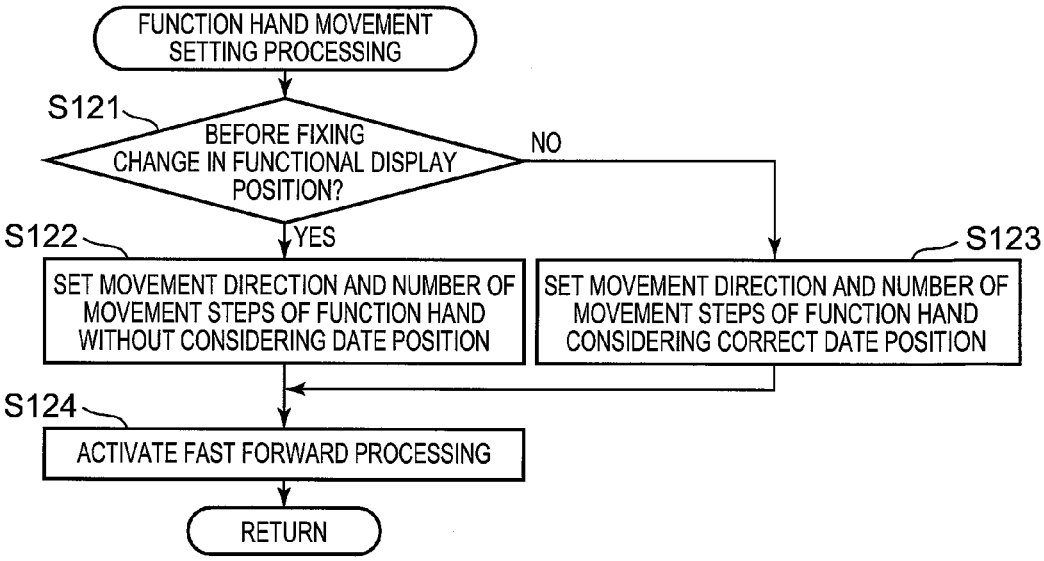
FIG. 4 is a flowchart showing a control procedure of function hand movement setting processing.

FIG. 4 is a flowchart showing a control procedure by the CPU 31 of the function hand movement setting processing which is invoked and executed in the functional display position change processing.

When the function hand movement setting processing is started, the CPU 31 first determines whether the processing is before fixing the setting of the functional display position in the functional display position change processing (step S121). Specifically, the CPU 31 determines whether the processing follows the arrow "YES" in step S105. If it is determined that the setting of the functional display position is not fixed, that is, if it is determined that the processing does not follow the arrow "YES" in the determination processing of step S105 (YES in step S121), the CPU 31 sets the rotation direction and the number of rotation steps for moving the function hand 58 to the destination setting position at the earliest without consideration of the position of the date wheel 59 (step S122). Then, the processing of the CPU 31 shifts to step S124.

On the other hand, if it is determined that the setting of functional display position is fixed, that is, if it is determined that the processing follows the arrow "YES" at the determination processing of step S105 (NO in step S121), the CPU 31 sets the rotation direction and the number of rotation steps for moving both of the date wheel 59 and the function hand 58 to the destination setting positions at earliest (step S123). Then, the CPU 31 shifts the processing to step S124.

When the processing is shifted from step S122 or step S123 to step S124, the CPU 31 activates the fast forward processing of the function hand 58 (step S124). The fast forward processing is performed in parallel with and in priority to the other processing. Thereafter, the CPU 31 ends the function hand movement setting processing.

Figure 5A:
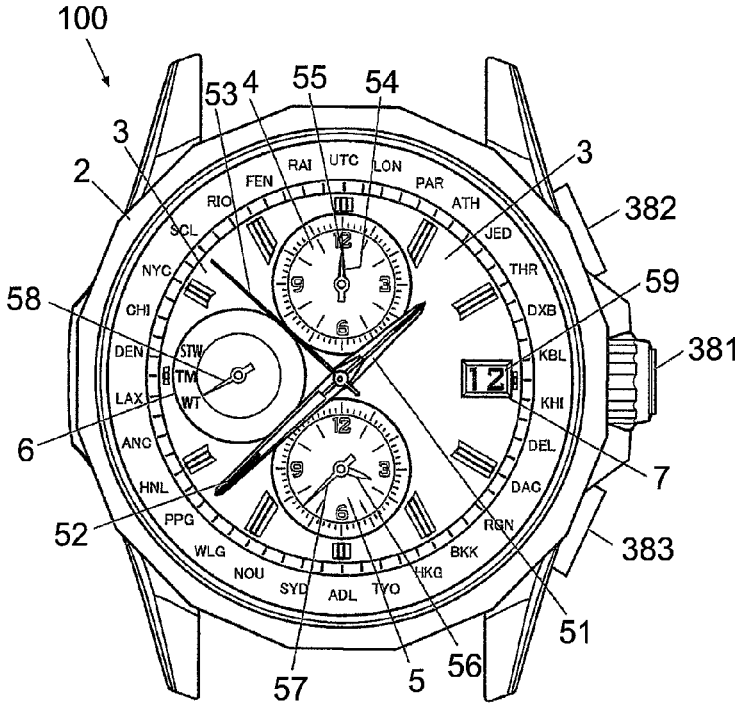
FIG. 5A is a plan view showing a display example when the position of functional displays is changed in the analog electronic timepiece.
Figure 5B:
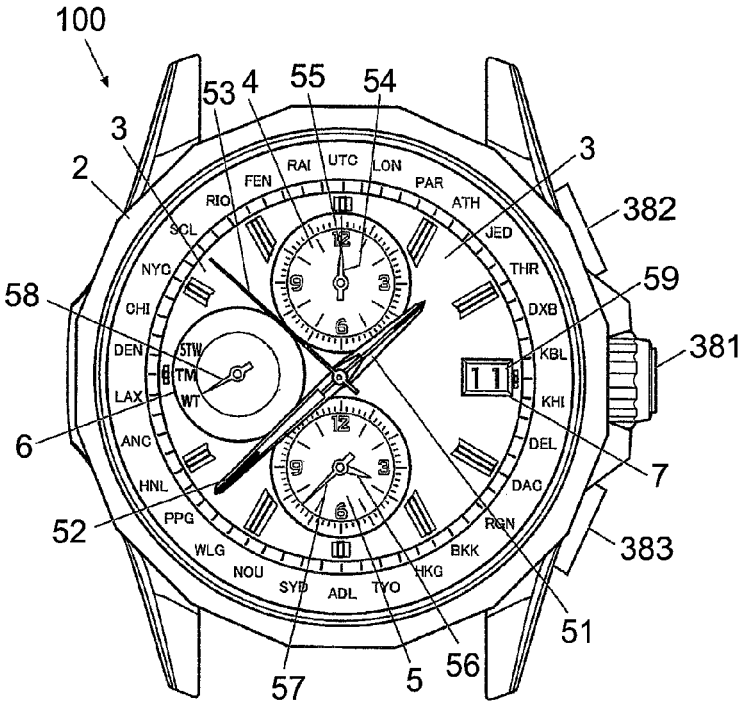
FIG. 5B is a plan view showing a display example when the position of functional displays is changed in the analog electronic timepiece.

FIGS. 5A and 5B are plan views of the analog electronic timepiece 100 showing display examples when a setting relating to functional display is changed from the display state of FIG. 1 in the analog electronic timepiece 100 of the embodiment.

In the state shown in FIG. 1, 3:37 and 52 seconds which is the current time in Tokyo is indicated by the current time display performed in the center display area. In the display area 4, as the world clock display, 13:37 (and 50 to 59 seconds) which is the current time in New York (−14 hours compared with Tokyo) is displayed. In the display area 5, zero (zero minute and zero second) indicating the reset state in the stopwatch function is displayed.

At that time, the date wheel 59 follows the current time display performed as the center display and the date indicator indicating the 12th which is the date in Tokyo is located so as to be exposed through the small window 7. On the other hand, the date in New York at that time is the 11th which is the previous day of the 12th.

In such case, when the user performs input operation into the operation unit 38, the crown 381 is rotated for a predetermined angle after being drawn out to the first level (YES in step S101) and the displays of the three display areas are shifted one by one (step S102), as shown in FIG. 5A, 13:37 which is the current time in New York is displayed as a display relating to the world clock in the center display area. Then, rotation operation of the function hand 58 to the position of the type indicator "WT" is set (step S103), the rotation direction and the number of rotation steps of the function hand 58 are determined according to the setting and the function hand 58 is rotated (step S104).

The angle from the position of type indicator "TM" to the position of type indicator "WT" is −30 degrees (forward direction is indicated by positive values). On the other hand, in addition to the function hand 58, in order to accurately match the position of the date wheel 59 to the world clock display by moving the date wheel 59 from the display position of 12th which is the date in Tokyo to the display position of 11th which is the date in New York, the function hand 58 needs to make 12 (4320 degrees) rotations in the backward direction and further needs to be rotated by 30 degrees in the backward direction.

Since the function hand movement setting processing of step S104 is performed before the change of functional display position is fixed (YES in step S121), only the position of the function hand 58 is set to be changed without consideration of the position of the date wheel 59. That is, the function hand 58 is set to be rotated for 30 degrees in the backward direction (step S122). Then, the fast forward processing is invoked (step S124), and the function hand 58 points at the type indicator "WT" while the date wheel 59 displays the 12th.

Thereafter, the crown 381 is pushed back (YES in step S105), and when the change of functional display position is fixed, the function hand movement setting processing is invoked again (step S106). Since the change of the functional display position is already fixed in the function hand movement setting processing executed at this timing (NO in step S121), in addition to the position of the function hand 58, the rotation direction and the number of rotation steps are set so that the date wheel 59 accurately indicates the date in the world clock display performed in the center display area. That is, the function hand 58 is set to be rotated for 4320 degrees in the backward direction so as to shift the state where the date 12th and the type indicator "WT" are displayed to the state where the date 11th and the type indicator "WT" are displayed (step S123). Then, the fast forward processing is activated (step S124), and the date display is changed to the 11th as shown in FIG. 5B.

Figure 6:
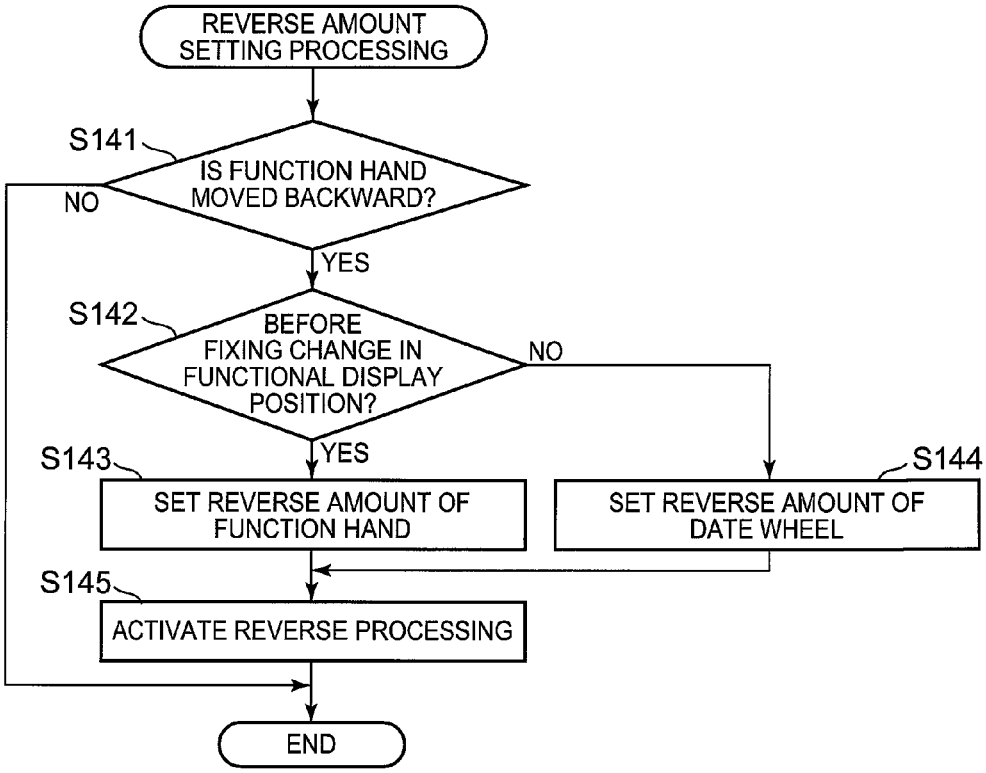
FIG. 6 is a flowchart showing a control procedure of reverse amount setting processing.

FIG. 6 is a flowchart showing a control procedure by the CPU 31 of the reverse amount setting processing performed in the analog electronic timepiece 100.

The reverse amount setting processing is invoked after the fast forward operation of the function hand 58 which is invoked in step S124 of the function hand movement setting processing.

When the reverse amount setting processing is started, the CPU 31 determines whether the rotation direction of the function hand 58 in the fast forward processing is the backward direction (step S141). If it is determined that the rotation direction is not the backward direction (NO in step S141), the CPU 31 ends the reverse amount setting processing.

On the other hand, if it is determined that the rotation direction of the function hand 58 is the backward direction (YES in step S141), the CPU 31 determines whether the current processing is before fixing the setting of the functional display position in the functional display position change processing (step S142). If it is determined that the setting of the functional display position is before fixation (YES in step S142), the CPU 31 sets the number of reverse steps relating to the reverse of the function hand 58 which is previously stored in the ROM 32 as the reverse amount (step S143). Then, the processing of the CPU 31 shifts to step S145.

If it is determined that the setting of the functional display position is already fixed (NO in step S142), the CPU 31 sets the number of reverse steps relating to the reverse of the date wheel 59 which is previously stored in the ROM 32 as the reverse amount (step S144). Then, the processing of the CPU 31 shifts to step S145.

When the processing shifts from step S143 or S144 to step S145, the CPU 31 activates the reverse processing (step S145). The reverse processing is activated in parallel with the other processing and executed in priority, similarly to the fast forward processing. The CPU 31 eliminates the plays which generate idle rotation with respect to the forward rotation for only the function hand 58 or both of the function hand 58 and the date wheel 59 by executing the reverse processing. Then, the CPU 31 ends the reverse amount setting processing.

As described above, the analog electronic timepiece 100 of the embodiment includes a stepping motor 78, a function hand 58 which is rotated by one degree by the step drive of the stepping motor 78, and a date wheel 59 which is rotated by 1/372 degrees in conjunction with the function hand 58. There is a case where the CPU 31 makes the function hand 58 rotationally move to the setting position independently and a case where the CPU 31 makes both of the function hand 58 and the date wheel 59 rotationally move to the setting positions. When the functional display position change processing to operate the function hand 58 is started, the function hand 58 is operated independently, and after the functional display position is fixed in the functional display position change processing and the position to be pointed by the function hand 58 is finally fixed, both of the function hand 58 and the date wheel 59 rotationally move to the setting positions. Accordingly, even in a case where the function hand 58 and the date wheel 59 are rotated in conjunction with each other by a single stepping motor 78, the position to rotate the date wheel 59 is not considered when operating the function hand 58, and thus, it is possible to promptly move the function hand 58 to the position which is set to perform display without making the user waiting for a long time needlessly. During such operation, since it is not generally assumed that the user needs the date information displayed by the date wheel 59, the reduction of usability for the user can be suppressed.

When hands having a large gear ratio are moved in conjunction with each other, since there is a large difference in the number of backlash steps between them in some cases, the number of reverse steps relating to the number of idle rotation steps in the forward direction according to the backlash is stored in the ROM 32, and the function hand 58 and the date wheel 59 can be rotationally moved to appropriate positions by the reverse operation. Especially, when performing rotation operation of only the function hand 58, by not considering the idle rotation of the date wheel 59, it is possible to move the function hand 58 to the setting position in a short time without increasing the number of reverse operation steps of the function hand 58 needlessly. On the other hand, when operating the date wheel 59, the reverse operation can be performed by the number of reverse steps of the date wheel 59.

Also, even while changing the date, when the change operation of the functional display position is performed, the date change operation is interrupted and the operation of the function hand 58 according to the change in the functional display position is performed in priority, which enables comfortable operation without making the user wait needlessly.

When moving only the function hand 58 to the setting position without consideration of the rotation position of the date wheel 59, since the function hand 58 is rotated in the direction which the function hand 58 can reach the setting position at the earliest without consideration of the rotation direction of moving the date wheel 59, excess time is not required for operating the function hand 58 when changing the functional display position and the user can perform the operation smoothly.

Also, since the angle of step rotation of the function hand 58 is an integral multiple of the angle of step rotation of the date wheel 59, it is easy to adjust the position of the function hand 58 regardless of the position of the date wheel 59.

Since the analog electronic timepiece 100 includes the operation unit 38 and the user can shift the processing to the operation mode according to the change of functional display position by drawing the crown 381 of the operation unit 38 to the first level and fix the setting relating to the change of functional display position by pushing back the crown 381 which has been drawn, the user can change the display position easily.

By combining the function hand 58 for displaying the function type displayed by the other hands 51 to 57 with the date wheel 59 and rotating them in conjunction with each other by a single stepping motor 78 in such way, it is possible to effectively operate, by the single stepping motor 78, the two indicating units which are less frequently used and the display information of which is less likely to be needed by the user at the same time. That is, a single stepping motor can be assigned to each one of the operations of the other hands which are highly independent.

[Modification Example]

Figure 7:
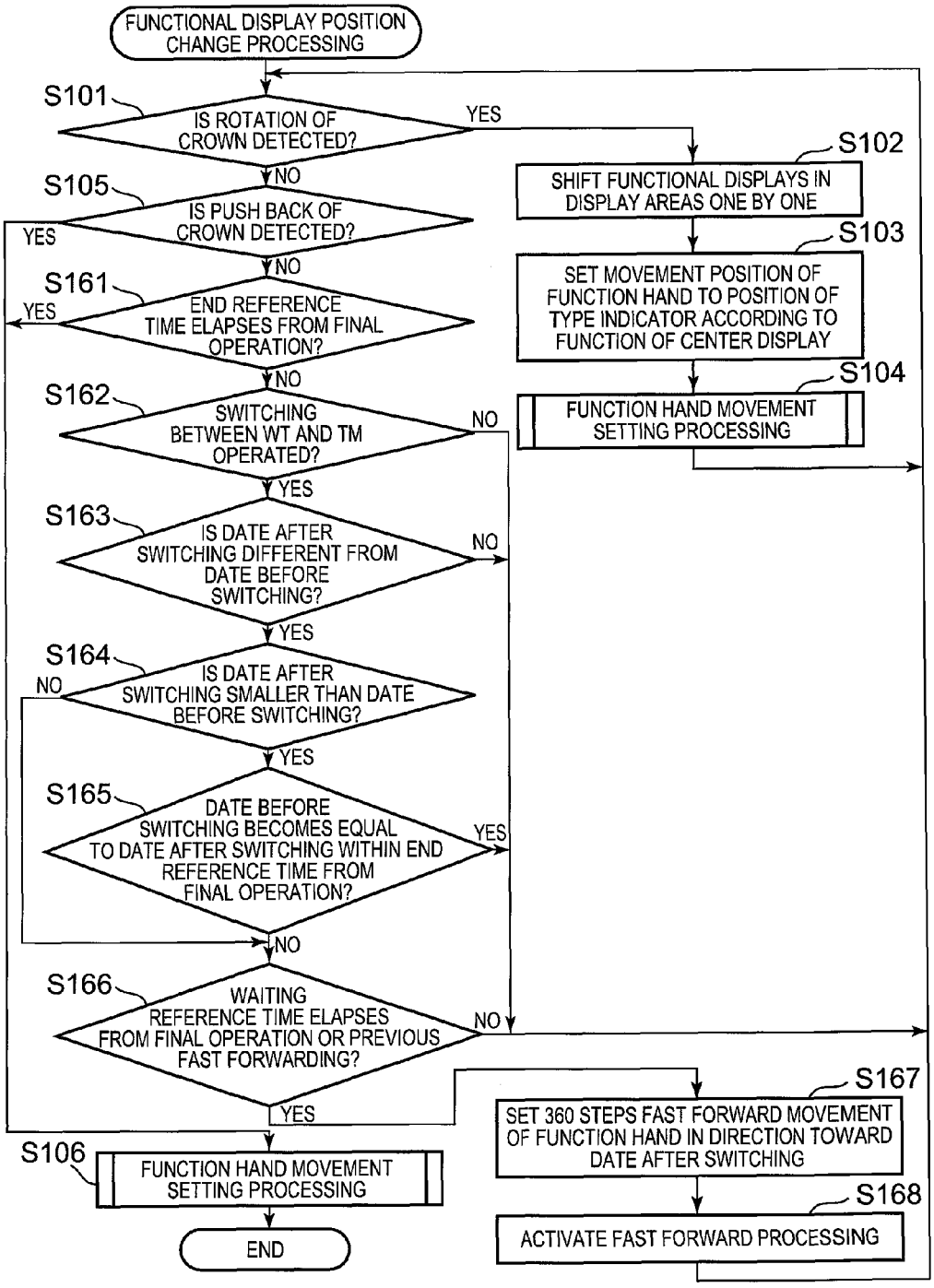
FIG. 7 is a flowchart showing a modification example of the control procedure of the functional display position change processing.

FIG. 7 is a flowchart showing a modification example of the control procedure of the functional display position change processing by the CPU 31.

Since the functional display position change processing of the modification example is similar to the functional display position change processing in the embodiment except that processing of steps S161 to S168 is added, the detailed explanation thereof is omitted by providing same reference numerals to the same controlling.

In the determination processing of step S105 in the functional display position change processing of the modification example, if it is determined that the push back operation of crown is not detected (NO in step S105), the CPU 31 determines whether an end reference time elapsed from the last operation (step S161). If it is determined that the end reference time elapsed (YES in step S161), the CPU 31 fixes the setting of functional display position and shifts the processing to step S106.

If it is determined that the end reference time did not elapse (NO in step S161), the CPU 31 determines whether display state is switched between the world clock display and the current time display after the functional display position change processing is started (step S162). If it is determined that the display state is not switched between the world clock display and the current time display (NO in step S162), the processing of the CPU 31 returns to step S101.

If it is determined that display state is switched between the world clock display and the current time display (YES in step S162), the CPU 31 determines whether the date to be displayed is different between before and after the change (switch) of the display state (step S163). If it is determined that the date is not different between before and after the switching (NO in step S163), the processing of the CPU 31 returns to step S101.

If it is determined that the date is different before and after the switching (YES in step S163), the CPU 31 further determines whether a value of the date after switching is smaller than the date before switching (step S164). Here, the large and small of the date is determined in the direction which date indicators are arranged on the date wheel 59, and the last date of each month is determined to be smaller than the first date of the next month. If it is determined that the date after switching is smaller than the date before switching (YES in step S164), it is determined whether the date before switching becomes equal to the date after switching by the time the end reference time elapsed from the detection of the last operation (final operation) of the crown 381 (step S165). If it is determined that the date before switching becomes equal to the date after switching (YES in step S165), the processing of the CPU 31 shifts to step S101. If it is determined that the date before switching does not become equal to the date after switching (NO in step S165), the processing of the CPU 31 shifts to step S166.

In the determination processing of step S164, if it is determined that the date after switching is not smaller (larger) than the date before switching (NO in step S164), the processing of the CPU 31 shifts to step S166.

When shifting to the processing of step S166, the CPU 31 determines whether a waiting reference time (predetermined waiting time, predetermined time interval) elapsed from the timing of the final operation or the timing when the processing follows the arrow "YES" in the previous processing of step S166 (step S166). The waiting reference time is shorter than the end reference time, and for example, obtained by dividing the end reference time into a predetermined number of times such as six times, for example. If it is determined that the waiting reference time did not elapse (NO in step S166), the CPU 31 returns to the processing of step S101.

If it is determined that the waiting reference time elapsed (YES in step S166), the CPU 31 performs setting to fast forward the function hand 58 for 360 steps in the direction of rotational movement toward the date after switching (step S167). Then, after activating the fast forward processing (step S168), the CPU 31 returns the processing to step S101.

As described above, the functional display position change processing of the analog electronic timepiece 100 in the modification example has a configuration that the function hand 58 makes twelve rotations in the display area 6 while the date indicators of the date wheel 59 are moved for one day, and when the function hand 58 is operated, the display of the date wheel 59 is not influenced much.

Since the function hand 58 can be moved to the setting position at every rotation of the function hand 58, in a case where the date display is to be changed by the switching between the current time display and the world clock display and the user is not performing the input operation for a while during the functional display position change operation, for example, the function hand 58 can be moved by one rotation in the meantime. By moving the function hand 58 gradually while operation is not performed in such way, the operation is not influenced while it is possible to effectively reduce the movement amount after fixing the functional display position change operation.

The present invention is not limited to the above embodiments and various changes can be made.

For example, in the embodiment, the function hand 58 is combined with the date wheel 59; however, the present invention can be applied to the combination of hands including a plurality of rotating plates which are rotated in conjunction with each other by different step rotation angles. For example, a rotating plate or hand used for displaying a day of week may be used instead of the date wheel, and the function hand 58 may be used, instead of displaying the function type, for other modes such as alarm operation, turning on and off the setting of summer time, and turning on and off the output of operation sound of the push buttons 382 and 383. Alternatively, the functional display itself such as display relating to the output from a sensor measuring physical quantities may be performed, for example.

In the embodiment, the exposed date indicator on the date wheel 59 is changed for one day as the function hand 58 makes a predetermined number of rotations; however, the ratio of step rotation angle can be set arbitrarily as long as both of the function hand 58 and the date wheel 59 can be rotated to perform accurate display at the ratio.

The embodiment has been described by taking a case where the function hand 58 and the date wheel 59 have different numbers of idle rotation steps; however, the reverse amount can be controlled normally in a case where the hands have the same number of idle rotation steps.

In the embodiment, in a case where the function hand 58 is operated independently, the function hand 58 is rotated in the direction which the function hand 58 reaches the destination in a shorter time; however, the rotation direction may be limited.

The embodiment has been described by taking a case where the three function types are exchanged among the three display areas; however, each of the function types may be switched to a function selected among four or more of the function types. Also, all of the function types to be displayed in the display areas do not need to be changed, and only the display of the center display may be switched, for example.

In the embodiment, there are described operations before and after fixing the change in the operation mode that is switching the functional display position on the basis of the user's operation. However, in an operation state where the function hand 58 performs display which is not based on the user's operation such as display relating to a receiving process of standard waves that is automatically performed at a preset time every day, for example, it is possible to switch whether to consider the position of the date wheel 59 between display relating to the receiving strength display during receiving and display relating to success or failure after receiving.

In the modification example, there has been described an example in which the date wheel 59 intermittently approaches the correct position gradually in a case where an input operation is not performed for the waiting reference time during the switching operation of the functional display position, and the switching operation is automatically ended in a case where an input operation is not performed for the predetermined end time. However, only one of the cases may be applied. Also, the switching operation may be ended when the date wheel 59 reaches the correct position by the intermittent operation, for example.

The embodiment has been described by taking a case where the date wheel 59 is moved while the functional display position is maintained; however, in a case of the display of sensor measurement value, which is not the functional display, the display of sensor measurement value may be changed to be reset at the first operation of the date wheel 59.

As for other details such as specific configurations, numeral values and the order of control processing shown in the embodiments, changes can be appropriately made within the scope of the present invention.

The entire disclosure of Japanese Patent Application No. 2013-058018 filed on Mar. 21, 2013 including description, claims, drawings, and abstract are incorporated herein by reference in its entirety.

What is claimed is:

1. An analog electronic timepiece, comprising:

a stepping motor which is driven by a step drive;

a first indicating unit which makes a step rotation by a first rotation angle according to the step drive;

a second indicating unit which makes a step rotation by a second rotation angle which is smaller than the first rotation angle in conjunction with the step rotation of the first indicating unit; and a controller which is configured to:

perform control to drive the stepping motor by the step drive to rotate a rotation position of the first indicating unit to a set rotation position, without regard to a rotation position of the second indicating unit, in an operation mode in which the set rotation position of the first indicating unit is changed; and perform control to drive the stepping motor by the step drive to rotate the rotation position of the first indicating unit to the set rotation position and to rotate a rotation position of the second indicating unit to a set rotation position, in response to the set rotation position of the first indicating unit being fixed in the operation mode in which the set rotation position of the first indicating unit is changed.

2. The analog electronic timepiece according to claim 1, further comprising:

a storage unit to store data regarding sizes of plays relating to rotations of gear trains in a predetermined direction, the gear trains respectively rotating the first indicating unit and the second indicating unit, wherein when the first indicating unit is moved in an opposite direction to the predetermined direction, the controller is configured to drive the stepping motor by the step drive to rotate the first indicating unit by a predetermined number of steps, which is equal to or larger than a size of a play of the first indicating unit, in the opposite direction and in the predetermined direction in order, in the operation mode in which the set rotation position of the first indicating unit is changed, and wherein when the second indicating unit is moved in the opposite direction to the predetermined direction, the controller is configured to drive the stepping motor by the step drive to rotate the first indicating unit and the second indicating unit by a predetermined number of steps, which is equal to or larger than a size of a play of the second indicating unit, in the opposite direction and in the predetermined direction in order, in response to the set rotation position of the first indicating unit being fixed in the operation mode in which the set rotation position of the first indicating unit is changed.

3. The analog electronic timepiece according to claim 2, wherein, when current processing is shifted to the operation mode in which the rotation position of the first indicating unit is changed during rotation of the second indicating unit, the controller interrupts the rotation of the second indicating unit.

4. The analog electronic timepiece according to claim 3, wherein the controller is configured to drive the stepping motor by the step drive to rotate the rotation position of the first indicating unit in a rotation direction in which the first indicating unit reaches the set rotation position of the first indicating unit in a shorter time, in the operation mode in which the set rotation position of the first indicating unit is changed.

5. The analog electronic timepiece according to claim 4, wherein the first rotation angle is set to be an integral multiple of the second rotation angle.

6. The analog electronic timepiece according to claim 3, wherein the first rotation angle is set to be an integral multiple of the second rotation angle.

7. The analog electronic timepiece according to claim 2, wherein the controller is configured to drive the stepping motor by the step drive to rotate the rotation position of the first indicating unit in a rotation direction in which the first indicating unit reaches the set rotation position of the first indicating unit in a shorter time, in the operation mode in which the set rotation position of the first indicating unit is changed.

8. The analog electronic timepiece according to claim 7, wherein the first rotation angle is set to be an integral multiple of the second rotation angle.

9. The analog electronic timepiece according to claim 2, wherein the first rotation angle is set to be an integral multiple of the second rotation angle.

10. The analog electronic timepiece according to claim 1, wherein, when current processing is shifted to the operation mode in which the rotation position of the first indicating unit is changed during rotation of the second indicating unit, the controller interrupts the rotation of the second indicating unit.

11. The analog electronic timepiece according to claim 10, wherein the controller is configured to drive the stepping motor by the step drive to rotate the rotation position of the first indicating unit in a rotation direction in which the first indicating unit reaches the set rotation position of the first indicating unit in a shorter time, in the operation mode in which the set rotation position of the first indicating unit is changed.

12. The analog electronic timepiece according to claim 11, wherein the first rotation angle is set to be an integral multiple of the second rotation angle.

13. The analog electronic timepiece according to claim 10, wherein the first rotation angle is set to be an integral multiple of the second rotation angle.

14. The analog electronic timepiece according to claim 1, wherein the controller is configured to drive the stepping motor by the step drive to rotate the rotation position of the first indicating unit in a rotation direction in which the first indicating unit reaches the set rotation position of the first indicating unit in a shorter time, in the operation mode in which the set rotation position of the first indicating unit is changed.

15. The analog electronic timepiece according to claim 14, wherein the first rotation angle is set to be an integral multiple of the second rotation angle.

16. The analog electronic timepiece according to claim 1, wherein the first rotation angle is set to be an integral multiple of the second rotation angle.

17. The analog electronic timepiece according to claim 16, wherein the second indicating unit selectively indicates, according to the rotation position thereof, one of a plurality of indicators each of which is provided at a predetermined angle interval, and wherein the first rotation angle and the second rotation angle have a relationship such that the first indicating unit is rotated by 360 degrees for a predetermined number of times while the second indicating unit is rotated by the predetermined angle interval.

18. The analog electronic timepiece according to claim 17, further comprising:

an operation unit which receives an input operation of a user, wherein the operation mode in which the set rotation position of the first indicating unit is changed includes a state of waiting for the input operation to the operation unit for changing the set rotation position of the first indicating unit, and wherein in a case where the input operation to the operation unit is not detected for a predetermined waiting time or more from when a setting relating to the rotation position of the first indicating unit is performed, the rotation selection unit fast forwards the first indicating unit at a predetermined time interval so as to be rotated by 360 degrees toward a rotation position of an indicator to be indicated by the second indicating unit.

19. The analog electronic timepiece according to claim 1, further comprising:

an operation unit which receives an input operation of a user, wherein the operation mode in which the set rotation position of the first indicating unit is changed includes a state of waiting for the input operation to the operation unit for changing the set rotation position of the first indicating unit.

20. The analog electronic timepiece according to claim 1, further comprising:

functional hands for performing display according to a plurality of functions, wherein the first indicating unit is a mode hand which indicates a function type of a content displayed by a part or all of the functional hands, and wherein the second indicating unit is a rotating plate which has, on a surface thereof, a plurality of indicators representing dates provided at predetermined angle intervals.

* * * * *